US007638992B2

(12) United States Patent
Kosugi

(10) Patent No.: US 7,638,992 B2
(45) Date of Patent: Dec. 29, 2009

(54) DRIVE POWER CONTROL DEVICE, LIQUID EJECTION APPARATUS, AND DRIVE POWER CONTROL METHOD

(75) Inventor: Yasuhiko Kosugi, Hata-machi (JP)

(73) Assignee: Seiko Epson Corporation, Tokyo (JP)

( * ) Notice: Subject to any disclaimer, the term of this patent is extended or adjusted under 35 U.S.C. 154(b) by 391 days.

(21) Appl. No.: 11/656,954

(22) Filed: Jan. 24, 2007

(65) Prior Publication Data

US 2007/0171258 A1 Jul. 26, 2007

(30) Foreign Application Priority Data

Jan. 24, 2006 (JP) ..... 2006-015430

(51) Int. Cl.
*G05F 1/00* (2006.01)

(52) U.S. Cl. ..... 323/281; 323/243

(58) Field of Classification Search ..... 323/234, 323/281–285, 274, 243
See application file for complete search history.

(56) References Cited

U.S. PATENT DOCUMENTS 4,253,055 A * 2/1981 Gatten ..... 323/284
5,293,077 A * 3/1994 Seki et al. ..... 307/10.8
6,501,236 B1 * 12/2002 Smith ..... 315/311
7,038,433 B2 * 5/2006 Fan et al. ..... 323/274

FOREIGN PATENT DOCUMENTS

JP 2000-218776 A 8/2000
JP 2002-166580 A 6/2002

* cited by examiner

*Primary Examiner*—Lamson D Nguyen
(74) *Attorney, Agent, or Firm*—Sughrue Mion, PLLC

(57) ABSTRACT

A drive power control device according to the present invention includes a transistor, which is input with a driving signal before current amplification into a base thereof, and which amplifies a current of the driving signal to drive an actuator; a switching element, which switches an input of a supply voltage to a collector of the transistor between on and off; and a voltage comparator, which compares a base voltage and a collector voltage of the transistor, and which controls the switching element such that the input of the supply voltage to the collector is turned off when a predetermined voltage difference occurs, and the input of the supply voltage to the collector is turned on when a predetermined voltage difference does not occur.

7 Claims, 8 Drawing Sheets

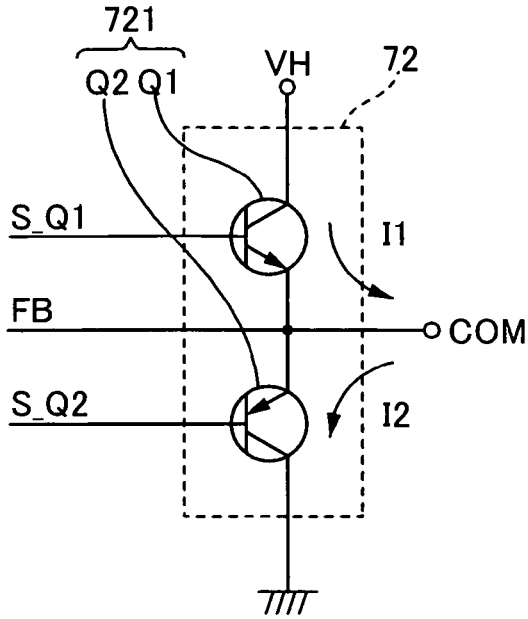
FIG. 6
FIG. 7A
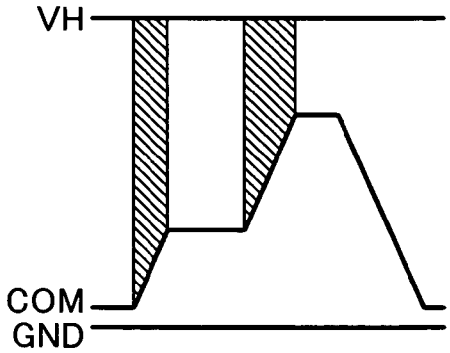
FIG. 7B
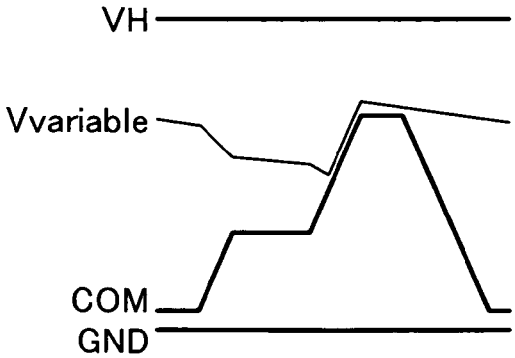

DRIVE POWER CONTROL DEVICE, LIQUID EJECTION APPARATUS, AND DRIVE POWER CONTROL METHOD

CROSS-REFERENCE TO RELATED APPLICATIONS

The present application claims priority upon Japanese Patent Application No. 2006-15430 filed on Jan. 24, 2006, which is herein incorporated by reference.

BACKGROUND OF THE INVENTION

1. Field of the Invention

The present invention relates to drive power control devices, liquid ejection apparatuses, and drive power control methods.

2. Description of the Related Art

As liquid ejection apparatuses ejecting liquid drops from a head, devices are known that eject liquid drops by applying driving voltages to an actuator. The driving signals that are used for this are generated by power amplification of a voltage waveform regulating a waveform (see for example JP-A-2000-218776 and JP-A-2002-166580).

Recently, as liquid ejection apparatuses are becoming smaller, there is a need for liquid ejection apparatuses that consume less power, so that they can be driven by batteries. The driving signals are generated by power amplifying voltage waveforms that regulate a waveform, as described above, but if it were possible to amplify the power such that no waste occurs during the power amplification, then it would be possible to achieve power savings.

SUMMARY OF THE INVENTION

The present invention has been made in view of the above-described situation, and it is one of its objects to provide a drive power control device, with which it is possible to achieve power savings during power amplification.

To achieve the above-noted object, a drive power control device according to the present invention includes:

a transistor, which is input with a driving signal before current amplification into a base thereof, and which amplifies a current of the driving signal to drive an actuator;

a switching element, which switches an input of a supply voltage to a collector of the transistor between on and off; and a voltage comparator, which compares a base voltage and a collector voltage of the transistor, and which controls the switching element such that the input of the supply voltage to the collector is turned off when a predetermined voltage difference occurs, and the input of the supply voltage to the collector is turned on when a predetermined voltage difference does not occur.

Other features of the present invention will become clear by reading the description of the present specification with reference to the accompanying drawings.

BRIEF DESCRIPTION OF THE DRAWINGS

FIG. 6 is a diagram illustrating the configuration of a current amplification circuit 72 of a reference example.

FIG. 7A is a diagram showing a constant voltage VH that is applied to a collector and the voltage of the driving signal COM. FIG. 7B is a diagram showing a voltage $V_{variable}$, which is obtained by letting the voltage of the driving signal COM partially follow the supply voltage that is input into the collector of a NPN transistor Q1.

DETAILED DESCRIPTION OF EXEMPLARY EMBODIMENTS

Figure 1:
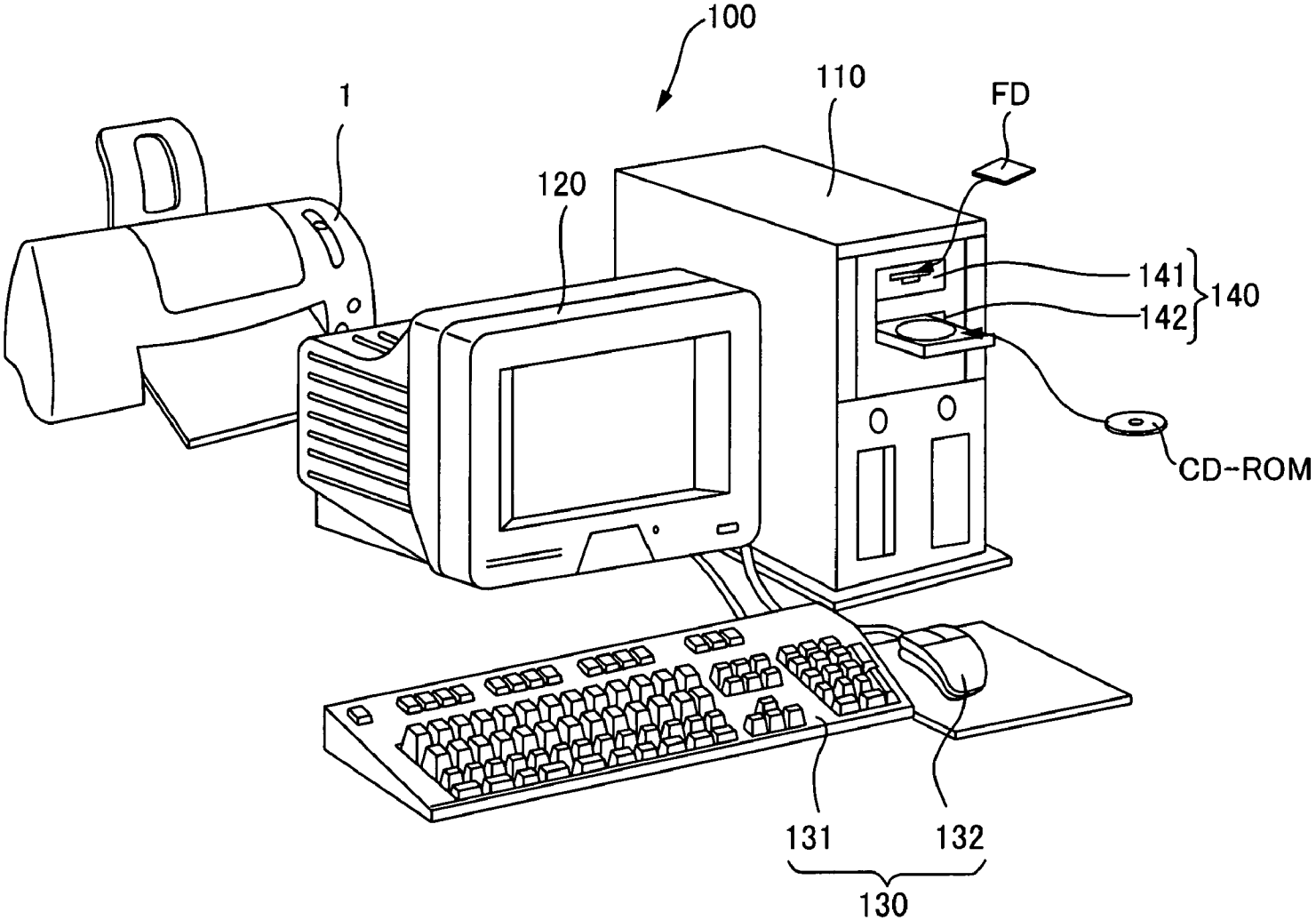
FIG. 1 is a diagram illustrating the configuration of a printing system 100.

At least the following matters will be made clear by the explanation in the present specification and the description of the accompanying drawings.

A drive power control device is disclosed, which includes:

a transistor, which is input with a driving signal before current amplification into a base thereof, and which amplifies a current of the driving signal to drive an actuator;

a switching element, which switches an input of a supply voltage to a collector of the transistor between on and off; and a voltage comparator, which compares a base voltage and a collector voltage of the transistor, and which controls the switching element such that the input of the supply voltage to the collector is turned off when a predetermined voltage difference occurs, and the input of the supply voltage to the collector is turned on when a predetermined voltage difference does not occur.

With this drive power control device, the voltage that is input into the collector of the transistor amplifying the driving signal can be controlled, so that it is possible to achieve power savings during power amplification.

It is preferable that this drive power control device further includes a coil between the switching element and the collector of the transistor. Moreover, it is preferable that this drive power control device further includes a capacitor, which is connected at one end to the collector of the transistor. Moreover, it is preferable that the transistor is an NPN transistor, the drive power control device further includes a PNP transistor, and the NPN transistor and the PNP transistor configure a push-pull circuit. Moreover, it is preferable that the voltage of the driving signal has an amplitude of a predetermined range. It is furthermore preferable that the transistor includes a heat sink. Thus, it is possible to control the voltage that is input into the collector of the transistor amplifying the driving signal, so that it is possible to achieve power savings during power amplification.

Moreover, a liquid ejection apparatus is disclosed, which includes:

a transistor, which is input with a driving signal before current amplification into a base thereof, and which amplifies a current of the driving signal to drive an actuator;

a switching element, which switches an input of a supply voltage to a collector of the transistor between on and off;

a voltage comparator, which compares a base voltage and a collector voltage of the transistor, and which controls the switching element such that the input of the supply voltage to the collector is turned off when a predetermined voltage difference occurs, and the input of the supply voltage to the collector is turned on when a predetermined voltage difference does not occur; and a liquid ejection section that ejects ink drops in accordance with the driving signal.

With this liquid ejection apparatus, the voltage that is input into the collector of the transistor amplifying the driving signal can be controlled, so that it is possible to achieve power savings during power amplification.

Moreover, a drive power control device is disclosed, which includes:

a transistor, which is input with a driving signal before current amplification into a base thereof, and which amplifies a current of the driving signal to drive an actuator;

a switching element, which switches an input of a supply voltage to a collector of the transistor between on and off; and a voltage comparator, which compares a base voltage and a collector voltage of the transistor, and which controls the switching element such that the input of the supply voltage to the collector is turned off when a predetermined voltage difference occurs, and the input of the supply voltage to the collector is turned on when a predetermined voltage difference does not occur;

a coil between the switching element and the collector of the transistor;

a capacitor, which is connected at one end to the collector of the transistor;

wherein the transistor is an NPN transistor, the drive power control device further includes a PNP transistor, and the NPN transistor and the PNP transistor configure a push-pull circuit;

the voltage of the driving signal has an amplitude of a predetermined range; and the transistor includes a heat sink.

Configuration of the Printing System

Overall Configuration

FIG. 1 is a diagram illustrating the configuration of a printing system 100. The printing system 100 shown in this example includes a printer 1 as a liquid ejection apparatus, and a computer 110. More specifically, the printing system 100 includes the printer 1, the computer 110, a display device 120, input devices 130, and recording/playing devices 140.

The printer 1 prints images on a medium such as paper, cloth, or film. It should be noted that the following description is for paper S (see FIG. 3), which is a representative medium, as an example of a medium. The computer 110 is connected such that it can communicate with the printer 1. In order to let the printer 1 print an image, the computer 110 outputs print data corresponding to this image to the printer 1. Computer programs, such as an application program for printing images and a printer driver, are installed on the computer 110. The display device 120 includes a display. The input devices 130 are for example a keyboard 131 and a mouse 132. The recording/playing devices 140 are for example a flexible disk drive 141 and a CD-ROM drive 142.

Configuration of the Computer

Configuration of the Computer 110

Figure 2:
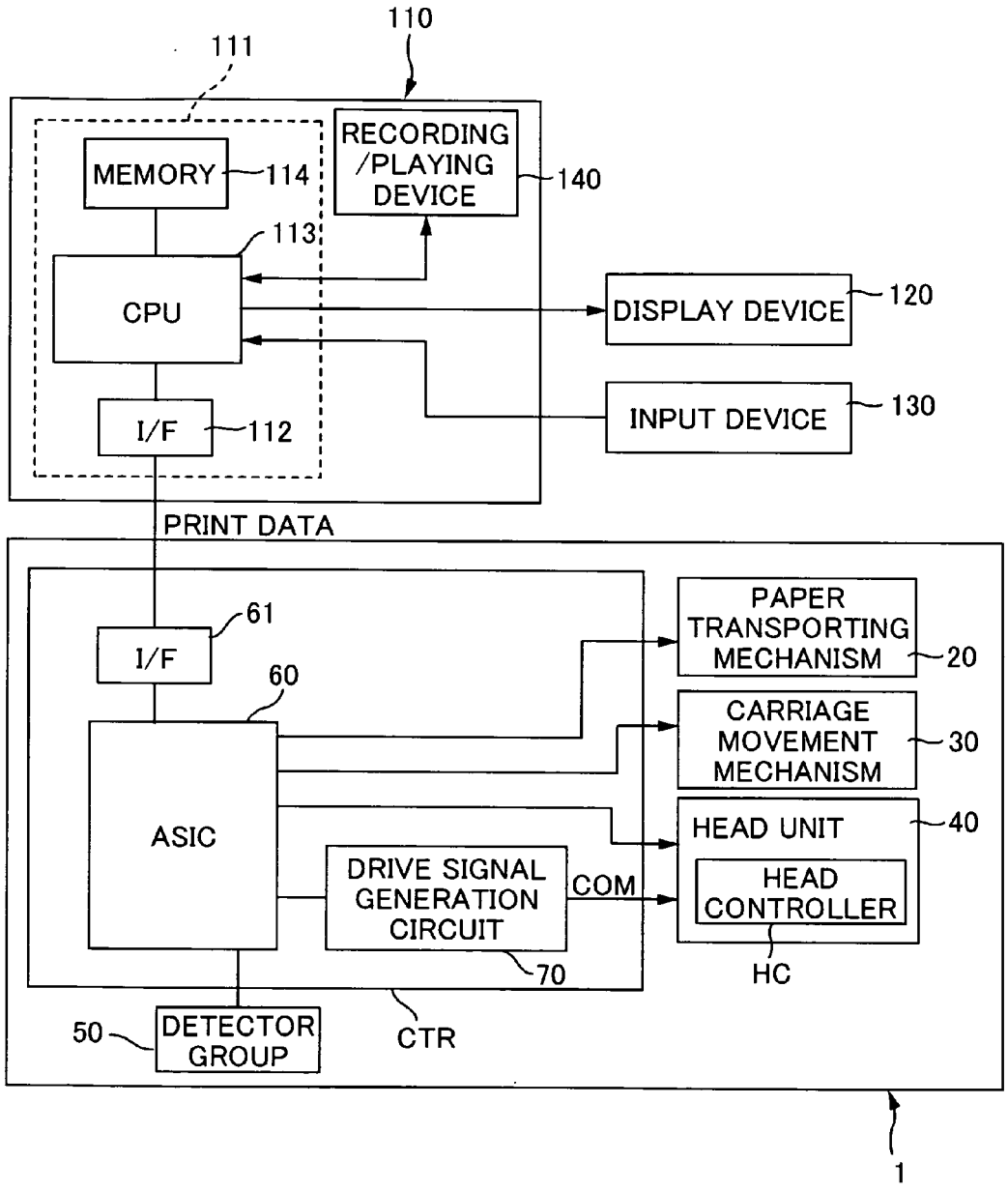
FIG. 2 is a block diagram illustrating the configuration of a computer 110 and a printer 1.

FIG. 2 is a block diagram illustrating the configuration of the computer 110 and the printer 1. First, the configuration of the computer 110 is explained in simple terms. The computer 110 includes a recording/playing device 140, as mentioned above, and a host-side controller 111. The recording/playing device 140 is connected such that it can communicate with the host-side controller 111 and is attached to the case of a computer 110, for example. The host-side controller 111 performs various kinds of controls in the computer 110, and is connected such that it can communicate with the above-noted display device 120 and also with the input devices 130. This host-side controller 111 includes an interface section 112, a CPU 113, and a memory 114. The interface section 112 interfaces with the printer 1 and exchanges data with it. The CPU 113 is an arithmetic processing device for carrying out the overall control of the computer 110. The memory 114 is for ensuring an area to store the computer programs used by the CPU 113 and a working area, or the like, and is configured by a RAM, EEPROM, ROM, magnetic disk device or the like. The CPU 113 performs various controls in accordance with the computer programs stored in the memory 114.

Configuration of the Printer

Configuration of the Printer 1

Figure 3:
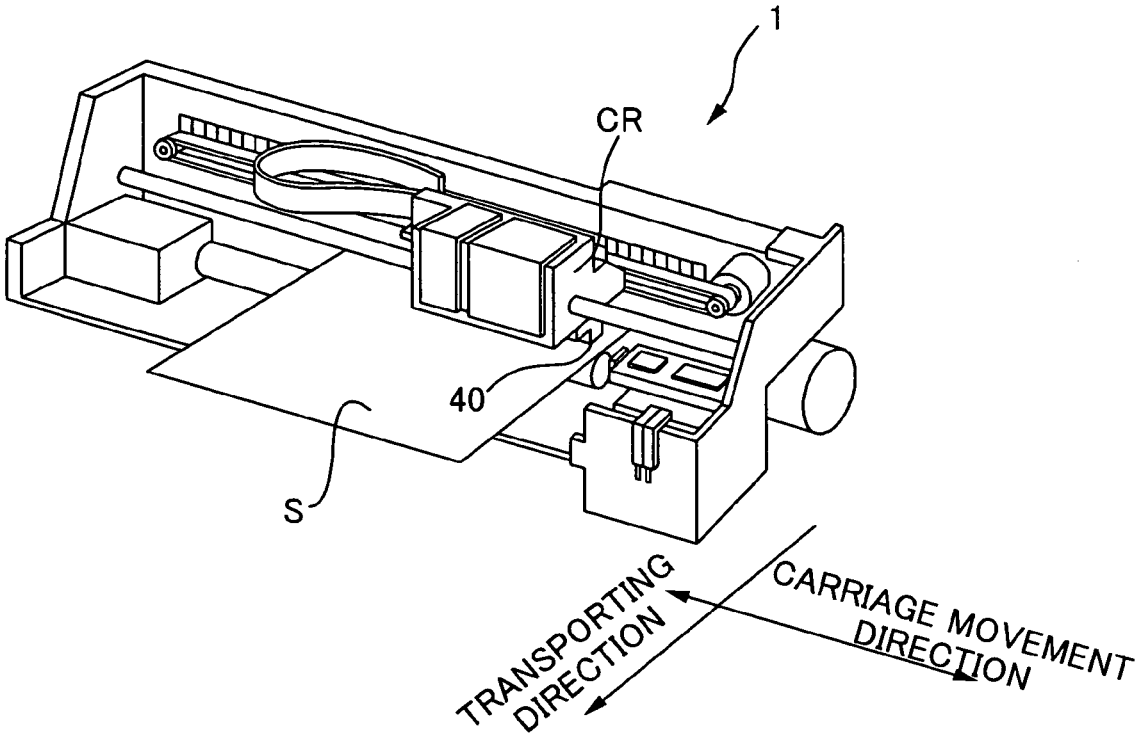
FIG. 3 is a diagram showing the configuration of the printer 1.

The configuration of the printer 1 is described next. Here, FIG. 3 is a diagram showing the configuration of the printer 1. It should be noted that the following explanations also refer to FIG. 2.

As shown in FIG. 2, the printer 1 includes a paper transporting mechanism 20, a carriage movement mechanism 30, a head unit 40, a detector group 50, an ASIC 60, and a driving signal generation circuit 70. Moreover, the head unit 40 includes a head controller HC.

In this printer 1, all parts to be controlled, that is, the paper transporting mechanism 20, the carriage movement mechanism 30, the head unit 40 and the driving signal generation circuit 70 are controlled by the ASIC 60. Under the control of the ASIC 60, the paper transporting mechanism 20 feeds the paper S up to a printable position, and transports the paper S by a predetermined transporting amount in the transporting direction. The carriage movement mechanism 30 is for moving the carriage CR to which the head unit 40 is attached in the carriage movement direction. Moreover, the detectors of the detector group 50 monitor the state inside the printer 1. Also, the detectors output their detection results to the ASIC 60. The ASIC 60 receives the detection results from the detectors, and controls the parts to be controlled based on these detection results.

It should be noted that the ASIC 60 includes a storage section storing, for example, waveform data for generating a driving signal COM, which is discussed below.

Driving Signal COM

The head unit 40 includes a nozzle row in which a plurality of nozzles is arranged in a row. A piezo element is attached to each nozzle, and ink drops are ejected by applying the driving signal COM. It should be noted that the same driving signal COM for ejecting the ink drops is used by all piezo elements corresponding to one nozzle row.

Figure 4:
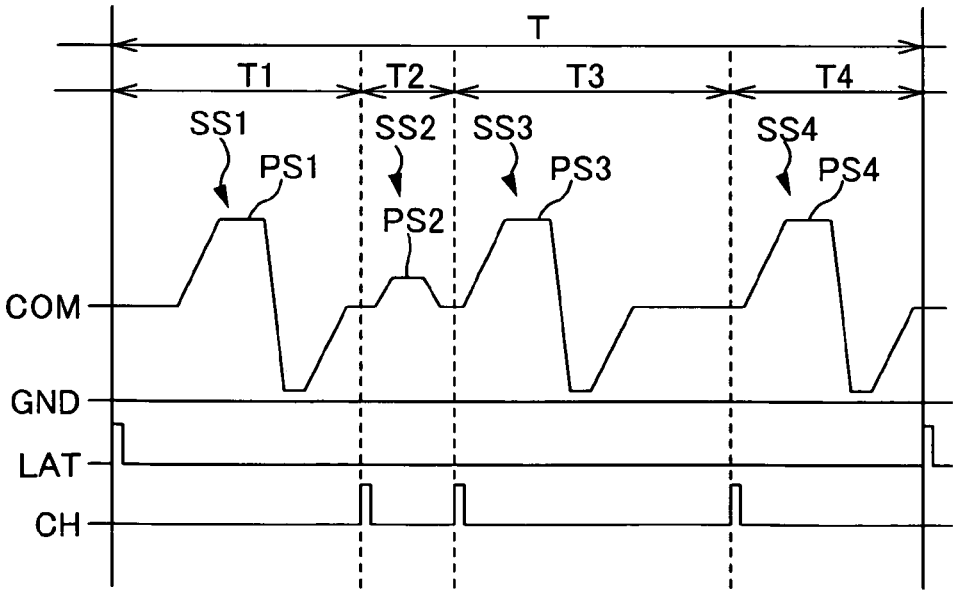
FIG. 4 is a diagram illustrating a driving signal COM that is generated by a driving signal generation circuit 70 and a control signal that is used during the formation of dots.

FIG. 4 is a diagram illustrating the driving signal COM that is generated by the driving signal generation circuit 70 and the control signals that are used during the formation of dots. As a control signal, a latch signal LAT and a change signal CH are used inside the later-discussed head controller HC as signals for discriminating the waveform portions.

As shown in FIG. 4, the driving signal COM includes a first waveform portion SS1 that is generated in a period T1, a second waveform portion SS2 that is generated in a period T2, a third waveform portion SS3 that is generated in a period T3, and a fourth waveform portion SS4 that is generated in a period T4 during a repetition cycle. Here, the first waveform portion SS1 includes a driving pulse PS1. Moreover, the second waveform portion SS2 includes a driving pulse PS2, the third waveform portion SS3 includes a driving pulse PS3, and the fourth waveform portion SS4 includes a driving pulse PS4.

The driving pulse PS1, the driving pulse PS3 and the driving pulse PS4 are used when ejecting ink from the above-mentioned nozzles, and all have the same waveform. Here, the driving pulse PS3 is applied to the piezo elements during the formation of small dots. Moreover, during the formation of medium dots, the driving pulse PS3 and the driving pulse PS4 are applied to the piezo elements, and during the formation of large dots, the driving pulse PS1, the driving pulse PS3 and the driving pulse PS4 are applied to the piezo elements. On the other hand, the driving pulse PS2 is a microvibration pulse for applying a microvibration to a meniscus, and is applied to the piezo element in the case that no dots are formed.

Thus, it is possible to generate a plurality of dot sizes by combining the applied driving pulse like this.

Head Controller HC

As shown in FIG. 2, the head controller HC is connected to the driving signal generation circuit 70, and the driving signal COM is supplied to it. The head controller HC applies the driving signal COM that is supposed to form such dots so that the desired image can be formed to the piezo elements that are each attached to each of the nozzles of the head unit 40.

It should be noted that the piezo elements correspond to liquid ejection sections that eject ink drops in accordance with the driving signal COM. Regarded as electric components, the piezo elements behave like capacitors.

Driving Signal Generation Circuit 70

Figure 5A:
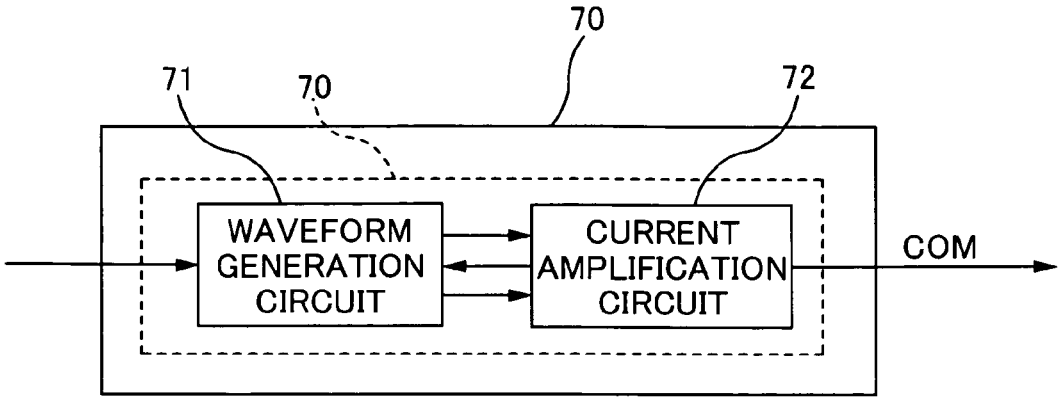
FIG. 5A is a block diagram illustrating the configuration of the driving signal generation circuit 70.
Figure 5B:
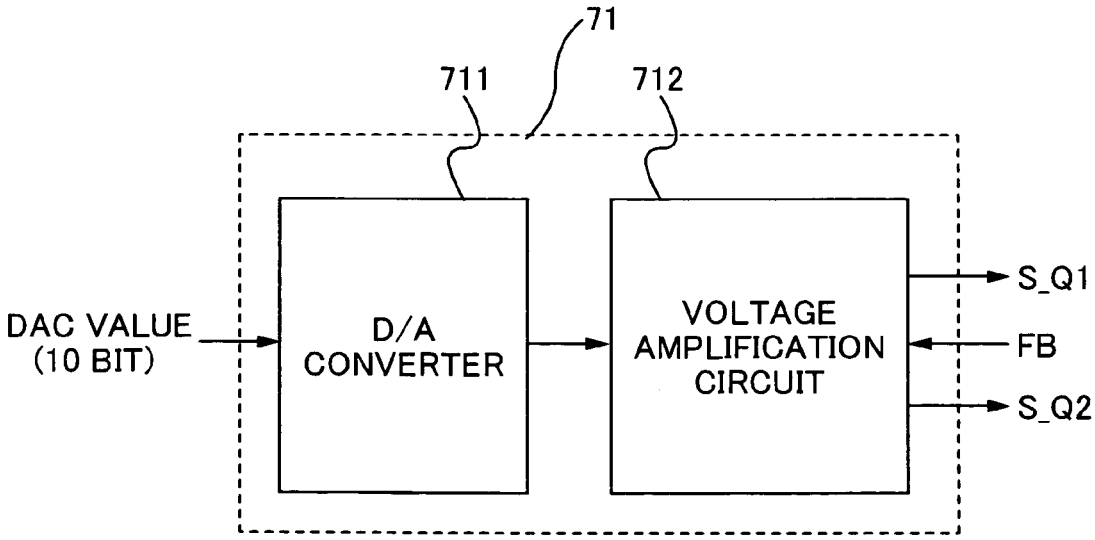
FIG. 5B is a block diagram illustrating the configuration of a waveform generation circuit 71.

The driving signal generation circuit 70 generates the driving signal COM including the driving pulses. This driving signal COM is used by all piezo elements together. FIG. 5A is a block diagram illustrating the configuration of the driving signal generation circuit 70. FIG. 5B is a block diagram illustrating the configuration of the waveform generation circuit 71.

The waveform generation circuit 71 includes a D/A converter 711 and a voltage amplification circuit 712. The D/A converter 711 is an electric circuit, which outputs a voltage signal in accordance with a DAC value. This DAC value is information indicating a voltage that is output from the voltage amplification circuit 712 (referred to as "output voltage" below), and is output from the ASIC 60 in accordance with the waveform data that is stored in the storage section of the above-described ASIC 60.

The voltage amplification circuit 712 amplifies the output voltage from the D/A converter 711 up to the voltage that is appropriate for the operation of the piezo elements. With the voltage amplification circuit 712 that is explained here, the output voltage from the D/A converter 711 is amplified up to a maximum of 42 (V). Moreover, the output voltage after the amplification is output as a signal S_Q1 and a signal S_Q2 to a current amplification circuit 72.

Configuration of Current Amplification Circuit 72 in Reference Example

The current amplification circuit 72 of a reference example is described next. FIG. 6 is a diagram illustrating the configuration of the current amplification circuit 72.

This current amplification circuit 72 is a circuit for supplying sufficient current so that a multitude of piezo elements can be operated without problems. The current amplification circuit 72 includes a transistor pair 721. Moreover, this transistor pair 721 includes an NPN transistor Q1 and a PNP transistor Q2 whose emitter terminals are connected to each other. The NPN transistor Q1 operates when the voltage of the driving signal COM increases. The collector of this NPN transistor Q1 is connected to the power source VH and its emitter is connected to an output signal line of the driving signal COM. It should be noted that the power source VH is a power source for supplying power to the transistors and supplies a constant voltage of 42 (V). The PNP transistor Q2 operates when the voltage drops. The collector of this PNP transistor Q2 is connected to ground (earth) and its emitter is connected to the output signal line of the driving signal COM. It should be noted that the voltage at the section where the emitters of the NPN transistor Q1 and the PNP transistor Q2 are connected together (the voltage of the driving signal COM) is fed back to the voltage amplification circuit 712, as is indicated by the characters "FB". Thus, the current amplification circuit 72 forms a push-pull circuit.

It should be noted that a heat sink not shown in the drawings is attached to the NPN transistor Q1 and the PNP transistor Q2.

The operation of this current amplification circuit 72 is controlled by the output voltage from the waveform generation circuit 71. For example, when the output voltage from the waveform generation circuit 71 is in an elevated state, the NPN transistor Q1 is turned on by the signal S_Q1. Accordingly, also the voltage of the driving signal COM is increased by the current flowing in. On the other hand, when the output voltage from the waveform generation circuit 71 is in a lowered state, the PNP transistor Q2 is turned on by the signal S_Q2. Accordingly, current flows off and also the voltage of the driving signal COM drops. It should be noted that if the output voltage from the waveform generation circuit 71 is constant, both the NPN transistor Q1 and the PNP transistor Q2 are off. As a result, the driving signal COM takes on a constant voltage.

It should be noted that these transistors correspond to transistors that amplify the current of the driving signal prior to the base current amplification.

FIG. 7A is a diagram showing the constant voltage VH applied to the collector and the voltage of the driving signal COM. From the foregoing explanations of the current amplification circuit 72, it follows that power consumption in the NPN transistor Q1 takes place when current flows between its collector and emitter, that is, when the voltage of the driving signal COM is increased. Moreover, the power that is consumed in the NPN transistor Q1 is the collector-emitter voltage of the NPN transistor Q1 multiplied by its collector-emitter current. Thus, if the collector-emitter current is taken to be constant, an amount of power that is proportional to the area of the collector (VH)-emitter (COM) voltage indicated by the hatched sections in FIG. 7A is consumed.

The current amplification circuit 72 of the reference example is configured such that a constant voltage VH is supplied to the collector during the generation of the driving signal COM. However, since the voltage of the driving signal COM has an amplitude of a certain range, it is not necessary to always supply a constant voltage exceeding the maximum voltage of the driving signal COM, and it is sufficient if a voltage that is only slightly higher than the voltage of the changing driving voltage COM is supplied. That is to say, in the case of the reference example the power that is consumed by the transistor indicated by the hatching in FIG. 7A is dissipated as heat or the like by the NPN transistor Q1 and is wasted.

FIG. 7B is a diagram showing a voltage $V_{variable}$ obtained by letting the supply voltage that is input into the collector of the NPN transistor Q1 partially follow the voltage of the driving signal COM. If for example a variable voltage $V_{variable}$ as shown in FIG. 7B is applied, then the collector ($V_{variable}$)-emitter (COM) voltage can be made smaller. That is to say, it becomes possible to make the area shown by the hatching in FIG. 7A smaller, and thus it becomes possible to decrease the power consumption.

In the embodiment described below, power savings are achieved by supplying a variable voltage $V_{variable}$ as shown in FIG. 7B to the current amplification circuit, by using a drive power control device including a DC/DC converter.

EMBODIMENTS

Drive Power Control Device

Figure 8:
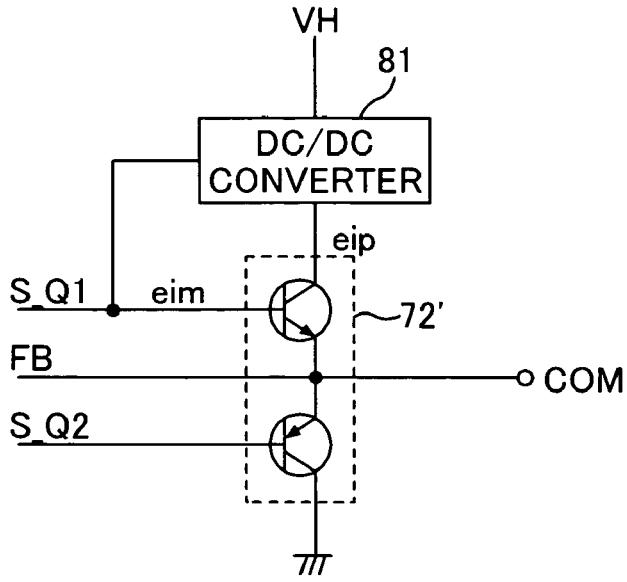
FIG. 8 is an explanatory diagram showing a DC/DC converter 81 and a current amplification circuit of this embodiment.

FIG. 8 is an explanatory diagram showing a DC/DC converter 81 and a current amplification circuit of this embodiment. The drive power control device is constituted by the DC/DC converter 81 shown in FIG. 8, and this DC/DC converter 81 substantially plays the role of the drive power control device. In this embodiment, the DC/DC converter 81 is connected to the base and the collector of the NPN transistor Q1 of a current amplification circuit 72'. It is furthermore connected to the power source VH. In the following, the various components of the DC/DC converter 81 are explained in detail.

DC/DC Converter 81

Figure 9:
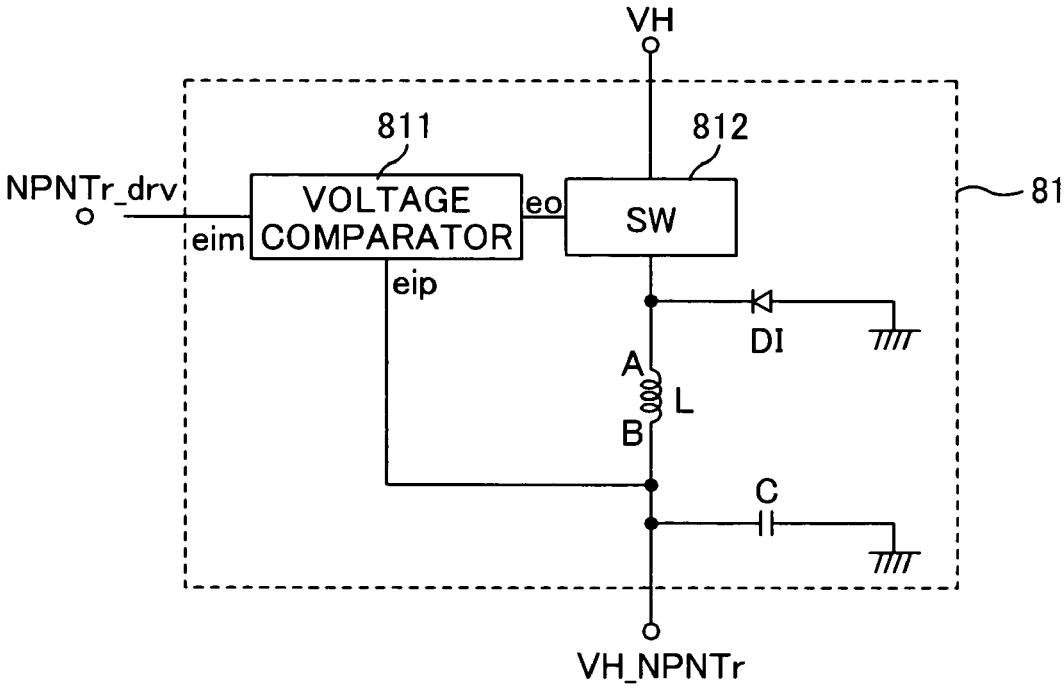
FIG. 9 is an explanatory diagram showing the DC/DC converter 81 of this embodiment.

FIG. 9 is an explanatory diagram showing the DC/DC converter 81 of this embodiment. The DC/DC converter 81 includes a voltage comparator 811, a switch 812, a diode DI, a coil L, and a capacitor C.

The voltage comparator 811 is connected to the base of the NPN transistor Q1 via a terminal NPNTr_drv. Moreover, the voltage comparator 811 is connected to the switch 812 and one end (on the side B) of the coil L, which is described below. The switch 812 is connected to the voltage comparator 811, the power source VH, and one end (on the side A) of the coil L. The side A of the coil L is furthermore connected to the cathode of the diode DI. The anode of the diode DI is connected to ground. Moreover, the side B of the coil L is connected to the collector of the NPN transistor Q1 via a terminal VH_NPNTr. The side B of the coil L is furthermore connected to one end of the capacitor C. The other end of the capacitor C is connected to ground.

In the following explanations, the voltage of the terminal NPNTr_drv is referred to as "eim", the voltage on the side B of the coil L from the voltage comparator 811 is referred to as "eip", and the voltage of the output from the voltage comparator 811 is referred to as "e0".

The voltage comparator 811 compares the base voltage of the NPN transistor Q1 with its collector voltage. When the collector voltage is equal to or higher than the base voltage plus 0.6 (V), then the voltage 0 is output to the switch 812, so that the switch 812 is switched off. On the other hand, when the collector voltage is less than the base voltage plus 0.6 (V), then a voltage turning the switch 812 on is supplied to the switch 812.

Under the control of the voltage eO that is output from the voltage comparator 811, the switch 812 supplies or shuts off the voltage of the power source VH with respect to the collector of the NPN transistor Q1. When the switch 812 is turned on, the voltage from the power source VH is supplied to the collector of the NPN transistor Q1, and when the switch 812 is turned off, the supply of the voltage from the power source VH to the collector is shut off.

As explained above, the coil L and the capacitor C are connected between the switch 812 and the NPN transistor Q1. This makes the sharp inflow of current due to the switching of the switch smoother by providing an impedance.

Thus, when the collector voltage of the NPN transistor Q1 is equal to or greater than the base voltage plus 0.6 (V), the voltage from the power source VH is not supplied to the collector of the NPN transistor Q1. On the other hand, when the collector voltage is lower than the base voltage plus 0.6 (V), the voltage from the power source VH is supplied to the collector of the NPN transistor Q1.

Voltage Comparator 811

Figure 10:
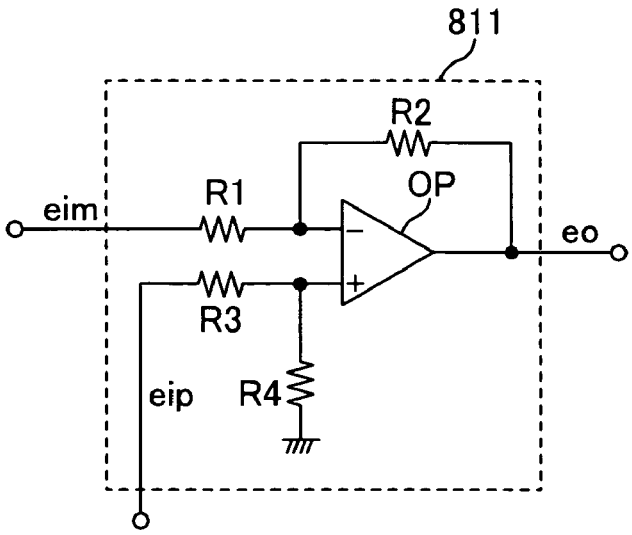
FIG. 10 is an explanatory diagram of a voltage comparator 811 in this embodiment.

FIG. 10 is an explanatory diagram of the voltage comparator 811 in this embodiment. The voltage comparator 811 includes an op-amp OP, a resistor R1, a resistor R2, a resistor R3 and a resistor R4.

One end of the resistor R1 and one end of the resistor R2 are connected to the negative terminal of the op-amp OP. The other end of the resistor R1 is connected via the terminal NPNTr_drv to the base of the NPN transistor Q1. The other end of the terminal R2 is connected to the output terminal of the op-amp OP. Moreover, the output terminal of the op-am OP is also connected to the switch 812. The positive terminal of the op-amp OP is connected via the resistor R3 to the collector of the NPN transistor Q1. Moreover, the positive terminal of the op-amp is connected to one end of the resistor R4. The other side of the resistor R4 is connected to ground.

The resistance of the resistors R1 to R4 is determined such that when the difference between the collector voltage eip and the base voltage eim becomes equal to or more than 0.6 (V), the output eO turns the switch 812 on.

The voltage comparator 811 compares the base voltage and the collector voltage of the transistor, and corresponds to a voltage comparator, which controls the switch 812 such that when a predetermined voltage difference is created, the input of the voltage supplied to the collector is turned off, and when a predetermined voltage difference is not created, the input of the voltage supplied to the collector is turned on.

Switch 812

Figure 11:
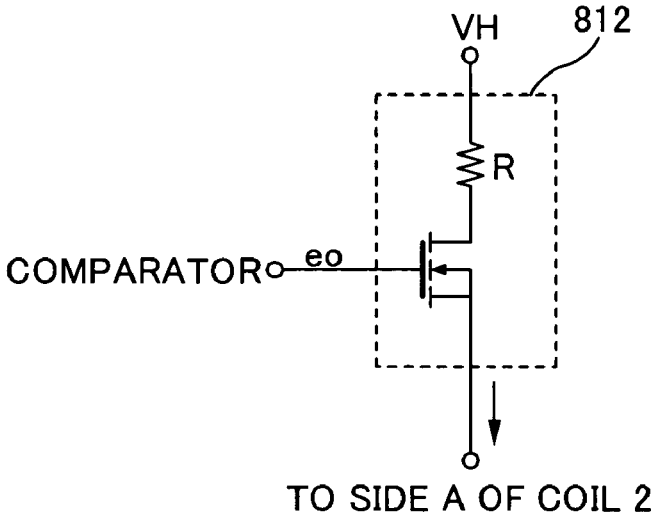
FIG. 11 is an explanatory diagram of a switch 812 in this embodiment.

FIG. 11 is an explanatory diagram of the switch 812 in this embodiment. As the switch 812 in this embodiment, a resistor R and an N-channel MOS-FET are used. One terminal of the resistor R is connected to the drain of the MOS-FET. The other end of the resistor R is connected to the power source VH supplying the supply voltage. The output eO from the voltage comparator 811 is connected to the gate of the MOS-FET. Moreover, the MOS-FET operates as a switch, which supplies or shuts off the voltage from the power source VH through the output eO from the voltage comparator 811. The side A of the above-described coil L is connected to the source of the MOS-FET.

The switch 812 corresponds to a switching element, which switches the input of the voltage supplied to the collector of the transistor between on and off.

Operation of the DC/DC Converter 81

Figure 12:
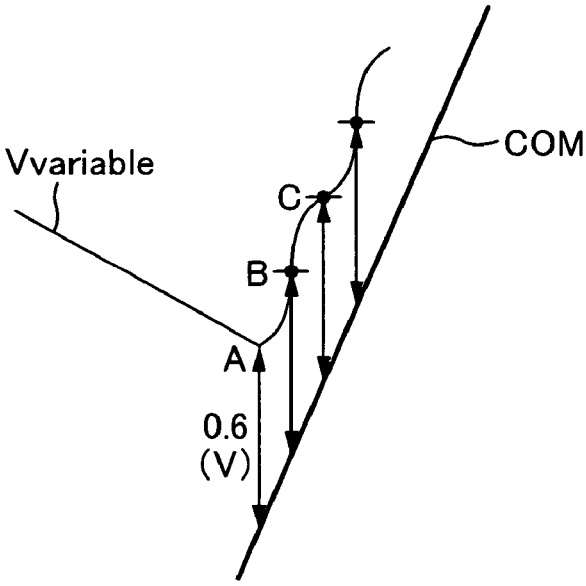
FIG. 12 is a diagram illustrating the variable voltage $V_{variable}$, which is the supply voltage in this embodiment.

The following is an explanation of the variable voltage $V_{variable}$ (=eip) that is input into the collector of the NPN transistor Q1 when the above-described DC/DC converter 81 is used. FIG. 12 is a diagram illustrating the variable voltage $V_{variable}$, which is the supply voltage in this embodiment. This diagram is an enlarged view of a portion in FIG. 7B.

During the rise of the output voltage from the waveform generation circuit 71, when the NPN transistor Q1 is turned on by the signal S_Q1, current flows into the collector, and power is consumed by the NPN transistor Q1. FIG. 12 is an enlarged view of the vicinity where the variable voltage $V_{variable}$ comes close to the driving signal COM. In this portion, the NPN transistor Q1 is turned on by the signal S_Q1. However, the variable voltage $V_{variable}$ is a voltage that is equal to or greater than the voltage of the driving signal COM plus 0.6 (V), so that the switch 812 is turned off. Thus, without supplying the supply voltage from the power source VH to the collector of the transistor Q1, power is supplied only from the capacitor C of the DC/DC converter 81, and the variable voltage $V_{variable}$ applied to the collector continues to drop.

As the voltage keeps dropping over time, the variable voltage $V_{variable}$ reaches the point A in FIG. 12. At the point A in FIG. 12, the variable voltage $V_{variable}$ becomes a voltage that is lower than the voltage of the driving signal COM plus 0.6 (V). Accordingly, the switch 812 is turned on, as explained above, and the supply voltage from the power source VH is supplied to the collector of the transistor Q1.

Here, one would expect that voltage is abruptly supplied to the collector of the transistor Q1 by turning on the switch 812, but due to the influence of the coil L and the capacitor C, which are arranged between the switch 812 and the transistor Q1, the voltage increases while describing a smooth curve, and the voltage $V_{variable}$ reaches the point B. At the point B, the variable voltage $V_{variable}$ becomes a voltage that is equal to or greater than the voltage of the driving signal COM plus 0.6 (V), so that the switch 812 is turned off. When the switch 812 is turned off, the supply voltage from the power source VH is blocked, so that the variable voltage $V_{variable}$ starts to drop. Also here, due to the influence of the coil L and the supply of the charge that has accumulated in the capacitor C, the voltage does not drop abruptly, and reaches the point C while describing a smooth curve. This operation is repeated, and the variable voltage $V_{variable}$ follows the rising voltage of the driving signal COM.

Here, the rising portion of the voltage of the driving voltage COM was explained, but in the region where the voltage of the driving signal COM is held at a constant voltage and the region where the voltage drops, a drop of the variable voltage $V_{variable}$ theoretically does not occur, because no power is consumed by the transistor Q1. However, the variable voltage $V_{variable}$ actually undergoes a slight voltage drop due to such components as the resistances included in the wiring and the like. Also the variable voltage $V_{variable}$ in this embodiment undergoes a slight voltage drop in the constant voltage region and the descending region of the driving signal COM.

Power Savings Brought about by the Drive Power Control Device

Figure 13:
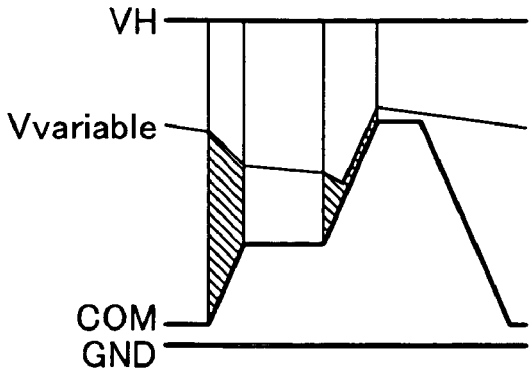
FIG. 13 is a diagram showing, in an overlapping manner, the voltages of the power source VH, the variable voltage $V_{variable}$, and the voltage of the driving signal COM.

The following is an explanation of the power savings that are realized by supplying the variable voltage $V_{variable}$ to the collector of the NPN transistor Q1. FIG. 13 is a diagram showing, in an overlapping manner, the voltages of the power source VH, the variable voltage $V_{variable}$, and the voltage of the driving signal COM. FIG. 13 can be said to be a diagram obtained by merging FIG. 7A and FIG. 7B. It should be noted, that the following explanations also refer to FIG. 7A.

As explained before, the power consumed by the NPN transistor Q1 corresponds to the collector-emitter voltage multiplied by the current flowing between collector and emitter. Here, to keep the explanations simple, the number of the applied piezo elements is assumed to be constant, and the amount of current when the current flows between collector and emitter is also assumed to be constant. Accordingly, the power that is consumed by the transistor Q1 is given as a value that is proportional to the value obtained by integrating the difference between the collector-emitter voltages over the period during which the current flows. That is to say, it is proportional to an amount obtained by integrating the voltage difference between the variable voltage $V_{variable}$ (the voltage applied to the collector in the present embodiment) shown in FIG. 13 and the voltage of the driving signal COM (the voltage applied to the emitter) over the period during which current flows.

As shown in FIG. 7A, a constant voltage VH was applied to the collector in the reference example. Thus, as explained above, the hatched region in FIG. 7A corresponds to the power consumed by the NPN transistor Q1. On the other hand, as shown in FIG. 13, since the voltage applied to the collector is $V_{variable}$, the power that is consumed by the NPN transistor Q1 in the present invention corresponds to the hatched region in FIG. 13. The power that is saved corresponds to the portion obtained by subtracting the hatched region in FIG. 13 from the hatched region in FIG. 7A, so as a result, power corresponding to the dotted region in FIG. 13 is saved by the drive power control device.

Thus, by introducing the drive power control device of this embodiment, the collector-emitter voltage of the NPN transistor Q1 can be reduced, and power savings in the power consumed by the NPN transistor Q1 can be achieved.

Other Embodiments

The foregoing embodiment is merely for facilitating the understanding of the present invention, but is not meant to be interpreted in a manner limiting the scope of the present invention. The invention can of course be altered and improved without departing from the gist thereof and includes functional equivalents. In particular, the embodiments mentioned below are also included in the invention.

Head

In the foregoing embodiment, ink was ejected using piezoelectric elements. However, the method for ejecting liquid is not limited to this. Other methods, such as a method of generating bubbles in the nozzles through heat, may also be employed.

Moreover, in the above-described embodiment, the head is provided on a carriage. However, it is also possible to provide the head on a removable ink cartridge.

Printer

In the printer of the above-described embodiment, a printer was described in which the head is provided on a carriage, and printing is performed by moving the head. However, the technology described in the foregoing embodiment can also be applied to a line-head printer.

Moreover, in the foregoing embodiment, a printer was described as an example of a liquid ejection apparatus, but liquid ejection apparatuses are not limited to printers. For example, it is also possible to apply the technology described in the foregoing embodiment to liquid ejection apparatuses that are utilized for the manufacture of color filters, for example of liquid crystal displays, or the pixel formation of organic electroluminescent displays or the like.

Overview (1) The drive power control device according to the above-described embodiment includes an NPN transistor Q1, into a base of which a pre-current amplification driving signal is input, and which amplifies the current of a driving signal COM for driving a piezo element serving as an actuator, and a switch 812 serving as a switching element, which switches the input of a supply voltage VH to the collector of this NPN transistor Q1 between on and off. Furthermore, this drive power control device includes a voltage comparator 811, which compares abase voltage and a collector voltage of the NPN transistor, and which controls the switch 812 such that the input of the supply voltage VH that is supplied to the collector is turned off when a predetermined voltage difference occurs, and the input of the supply voltage VH that is supplied to the collector is turned on when a predetermined voltage difference does not occur.

Here, the predetermined voltage difference in the present embodiment means that there is a voltage difference of 0.6 (V) between the collector voltage and the base voltage. That is to say, the voltage comparator 811 turns off the input of the supply voltage VH to the collector when there is such a voltage difference that the collector voltage is equal to or greater than the base voltage plus 0.6 (V). On the other hand, the voltage comparator 811 turns on the input of the supply voltage VH to the collector when there is such a voltage difference that the collector voltage is less than the base voltage plus 0.6 (V).

Thus, when a predetermined voltage difference does not occur, the supply voltage VH is supplied to the collector, and when the voltage difference occurs, the supply of the supply voltage VH is stopped, so that the supply voltage can be caused to change in such a manner that a voltage that is slightly higher than the voltage of the driving signal COM is supplied. Moreover, since the supply voltage can be caused to change such that it follows the voltage of the driving signal COM, it is possible to reduce the collector-emitter voltage, and to reduce the power that is consumed by the NPN transistor Q1.

(2) Moreover, the drive power control device further comprises a coil L between the switch 812 serving as the switching element and the collector of the NPN transistor Q1. In the present embodiment, only one coil L is shown, but it is also possible to use a plurality of coils.

Accordingly, a predetermined impedance is provided on the output side of the switch 812, so that even if the input of the supply voltage VH is switched instantly by the switch, an abrupt voltage change on the output side can be prevented.

(3) Furthermore, the drive power control device further comprises a capacitor C, one end of which is connected to the collector of the NPN transistor Q1. In this embodiment, only one capacitor C is shown, but it is also possible to use a plurality of capacitors.

Accordingly, even if the input of the supply voltage VH is switched instantly by the switch, an abrupt voltage change on the output side can be prevented.

(4) Furthermore, a PNP transistor Q2 is provided in addition to the above-mentioned NPN transistor Q1, and the NPN transistor Q1 and the PNP transistor Q2 constitute a push-pull circuit.

Accordingly, it is possible to amplify the power of the driving signal COM in accordance with the voltage that is output by the waveform generation circuit 71.

(5) Furthermore, the voltage of the driving signal COM has an amplitude of a predetermined range. In the present embodiment, it has an amplitude ranging from 0 (V) to 42 (V), but there is no limitation to this.

Thus, since the driving signal COM has an amplitude of a predetermined range, the voltage that is supplied to the collector is varied such that it follows this voltage, so that the power consumed by the transistor can be reduced.

(6) Furthermore, the NPN transistor Q1 comprises a heat sink. It should be noted that also the PNP transistor Q2 can comprise a heat sink.

Even though the NPN transistor Q1 comprises a heat sink, the power consumed by the NPN transistor can be reduced with the above-described drive power control device, so that the attached heat sink can be made small.

(7) Furthermore, with a drive power control device including all of the above-mentioned structural components, substantially all of the above-noted effects are displayed, so that the object of the present invention is attained most effectively.

(8) Furthermore, a printer 1 serving as a liquid ejection apparatus according to the above-described embodiment includes an NPN transistor Q1 into a base of which a pre-current amplification driving signal is input, and which amplifies the current of a driving signal COM for driving a piezo element serving as an actuator, and a switch 812 serving as a switching element, which switches the input of a supply voltage VH to the collector of this NPN transistor Q1 between on and off. Furthermore, this liquid ejection apparatus includes a voltage comparator 811, which compares a base voltage and a collector voltage of the NPN transistor, and which controls the switch 812 such that the input of the supply voltage VH to the collector is turned off when a predetermined voltage difference occurs, and the input of the supply voltage VH to the collector is turned on when a predetermined voltage difference does not occur. It furthermore includes piezo elements serving as liquid ejection sections that eject ink drops in accordance with the driving signal COM.

Thus, a supply voltage VH is supplied to the collector when a predetermined voltage difference does not occur and the supply of the supply voltage VH is stopped when the voltage difference does occur, so that the supply voltage is caused to change such that a slightly higher voltage than the voltage of the driving signal COM is supplied. Moreover, the supply voltage can be caused to change such that it follows the voltage of the driving signal COM, so that the collector-emitter voltage can be made smaller, and the power consumed by the NPN transistor Q1 can be made smaller. Accordingly, it is possible to provide a printer serving as a liquid ejection apparatus, with which the consumed power can be suppressed to a low level.

What is claimed is:

1. A drive power control device comprising:

a transistor, which is input with a driving signal before current amplification into a base thereof, and which amplifies a current of the driving signal to drive an actuator;

a switching element, which switches an input of a supply voltage to a collector of the transistor between on and off; and a voltage comparator, which compares a base voltage and a collector voltage of the transistor, and which controls the switching element such that the input of the supply voltage to the collector is turned off when a predetermined voltage difference occurs, and the input of the supply voltage to the collector is turned on when a predetermined voltage difference does not occur.

2. A drive power control device according to claim 1, further comprising a coil between the switching element and the collector of the transistor.

3. A drive power control device according to claim 1, further comprising a capacitor, which is connected at one end to the collector of the transistor.

4. A drive power control device according to claim 1, wherein the transistor is an NPN transistor;

the drive power control device further includes a PNP transistor; and the NPN transistor and the PNP transistor configure a push-pull circuit.

5. A drive power control device according to claim 1, wherein the voltage of the driving signal has an amplitude of a predetermined range.

6. A drive power control device according to claim 1, wherein the transistor includes a heat sink.

7. A drive power control method comprising:

inputting a driving signal before current amplification into a base of a transistor and amplifying, with the transistor, a current of the driving signal to drive an actuator;

comparing a base voltage and a collector voltage of the transistor;

controlling a switching element, which switches an input of a supply voltage to a collector of the transistor between on and off, such that the input of the supply voltage to the collector is turned off when a predetermined voltage difference occurs, and the input of the supply voltage to the collector is turned on when a predetermined voltage difference does not occur.

* * * * *